US010926323B2

(12) United States Patent
Yurko et al.

(10) Patent No.: US 10,926,323 B2
(45) Date of Patent: Feb. 23, 2021

(54) SYSTEMS AND METHODS FOR COUNTER GRAVITY CASTING FOR BULK AMORPHOUS ALLOYS

(71) Applicant: Materion Corporation, Mayfield Heights, OH (US)

(72) Inventors: James A. Yurko, Saratoga, CA (US); Edgar E. Vidal, Golden, CO (US); Nicholas W. Hitchinson, Toledo, OH (US)

(73) Assignee: Materion Corporation, Mayfield Heights, OH (US)

( * ) Notice: Subject to any disclaimer, the term of this patent is extended or adjusted under 35 U.S.C. 154(b) by 344 days.

(21) Appl. No.: 15/798,090

(22) Filed: Oct. 30, 2017

(65) Prior Publication Data

US 2018/0178277 A1 Jun. 28, 2018

Related U.S. Application Data

(63) Continuation of application No. 13/840,445, filed on Mar. 15, 2013, now Pat. No. 9,802,247.

(60) Provisional application No. 61/765,686, filed on Feb. 15, 2013.

(51) Int. Cl.

| | |
|---|---|
| ***B22D 18/06*** | (2006.01) |
| ***B22D 27/20*** | (2006.01) |
| ***B22C 9/20*** | (2006.01) |
| ***B22D 35/04*** | (2006.01) |
| ***B22D 27/04*** | (2006.01) |

(52) U.S. Cl.

CPC ..... *B22D 18/06* (2013.01); *B22C 9/20* (2013.01); *B22D 27/04* (2013.01); *B22D 27/20* (2013.01); *B22D 35/04* (2013.01)

(58) Field of Classification Search

CPC ..... B22D 18/06; B22D 27/04; B22D 27/15; B22D 27/20; B22D 35/04; B22C 9/20

USPC ..... 164/63, 257

See application file for complete search history.

(56) References Cited

U.S. PATENT DOCUMENTS

| | | | |
|---|---|---|---|
| 3,774,668 | A | 11/1973 | Heimgartner |
| 3,863,706 | A | 2/1975 | Chandley et al. |
| 3,900,064 | A | 8/1975 | Chandley et al. |
| 4,589,466 | A | 5/1986 | Chandley et al. |
| 4,791,977 | A | 12/1988 | Chandley |
| 5,044,420 | A | 9/1991 | Vanderjagt |
| 5,161,604 | A | 11/1992 | Chandley |
| 5,288,344 | A | 2/1994 | Pekker et al. |
| 5,431,212 | A | 7/1995 | Arakawa et al. |
| 5,711,363 | A | 1/1998 | Scruggs et al. |
| 5,758,712 | A | 6/1998 | Pedersen |
| 5,797,443 | A | 8/1998 | Lin et al. |

(Continued)

*Primary Examiner* — Kevin P Kerns

(74) *Attorney, Agent, or Firm* — Jones Day

(57) ABSTRACT

A counter gravity casting apparatus includes a reusable metal mold having a plurality of mold cavities, a feed tube configured to feed molten alloy into the mold, and a vacuum fitting configured to permit a vacuum to be applied to the mold. The mold includes multiple metal sections configured such that adjacent metal sections mate to one another, the metal sections being separable from one another. The metal sections include recesses that form the mold cavities, and the mold includes a sprue and multiple runner passages. The sprue is configured to receive molten alloy from the feed tube, and the multiple runner passages are configured to feed molten alloy from the sprue to the mold cavities. Methods of casting bulk amorphous alloy articles or feedstock is described.

20 Claims, 9 Drawing Sheets

(56) References Cited

U.S. PATENT DOCUMENTS

| | | | |
|---|---|---|---|
| 5,948,352 | A | 9/1999 | Vender Jagt et al. |
| 6,021,840 | A | 2/2000 | Colvin |
| 6,311,758 | B1 | 11/2001 | Sakabe et al. |
| 6,499,529 | B1 | 12/2002 | Farkas |
| 6,581,673 | B1 | 6/2003 | McKibben et al. |
| 6,592,689 | B2 | 7/2003 | Hays |
| 6,627,146 | B1 | 9/2003 | McKibben et al. |
| 6,637,496 | B1 | 10/2003 | Macheske et al. |
| 6,637,497 | B2 | 10/2003 | Herron |
| 6,666,254 | B2 | 12/2003 | Voigt |
| 6,684,934 | B1 | 2/2004 | Cargill et al. |
| 6,763,879 | B1 | 7/2004 | Macheske et al. |
| 6,766,850 | B2 | 7/2004 | Gegel et al. |
| 6,779,588 | B1 | 8/2004 | Good et al. |
| 7,070,665 | B2 | 7/2006 | Hays |
| 7,157,158 | B2 | 1/2007 | Collier et al. |
| 7,293,599 | B2 | 11/2007 | Peker et al. |
| 7,296,612 | B2 | 11/2007 | Bend |
| 8,079,401 | B2 | 12/2011 | Sundarraj et al. |
| 8,186,417 | B2 | 5/2012 | Ribeiro |
| 8,303,890 | B2 | 11/2012 | Grassi et al. |
| 8,312,913 | B2 | 11/2012 | Gervasi et al. |
| 8,333,230 | B2 | 12/2012 | Marsden et al. |
| 8,701,742 | B2 | 4/2014 | Waniuk et al. |
| 9,802,247 | B1 | 10/2017 | Yurko et al. |
| 2006/0157217 | A1 | 7/2006 | Bassi |
| 2007/0000635 | A1 | 1/2007 | Bend |
| 2008/0257519 | A1 | 10/2008 | Carrig et al. |
| 2008/0295991 | A1 | 12/2008 | Roth et al. |
| 2011/0163509 | A1 | 7/2011 | Pham et al. |
| 2013/0000862 | A1 | 1/2013 | Cretegny et al. |

(side view)

SYSTEMS AND METHODS FOR COUNTER GRAVITY CASTING FOR BULK AMORPHOUS ALLOYS

This application is a continuation application of U.S. patent application Ser. No. 13/840,445 filed Mar. 15, 2013, now U.S. Pat. No. 9,802,247, which claims the benefit of U.S. Provisional Patent Application No. 61/765,686 filed Feb. 15, 2013. The entire contents of each of the foregoing applications are incorporated herein by reference in their entireties.

BACKGROUND

Field of the Disclosure

The present disclosure relates to counter gravity casting of metallic alloys, and more particularly to counter gravity casting of bulk amorphous metal alloys and feedstock for bulk amorphous alloys.

Background Information

Counter gravity casting methods are known in the art for making investment castings using ceramic shell molds, such as described, for example, in U.S. Pat. Nos. 3,863,706, 3,900,064, 4,589,466, and 4,791,977. Such ceramic molds are formed by a process known as the lost wax process. The ceramic shell mold is disposed in a vacuum container, and a fill tube, which communicates with a riser passage that extends from the bottom of the ceramic shell mold, extends out of the container for immersion in a pool of molten metal. Application of a relative vacuum causes the fill tube to draw molten metal upwardly into the riser and mold cavities of the ceramic shell mold Methods are also known in the art for preparing and casting bulk amorphous alloys (also called bulk metallic glasses or BMG) of various compositions, such as, for example, U.S. Pat. Nos. 5,797,443, 5,711,363, 7,293,599, and 6,021,840.

The present inventors have observed a need for improved approaches for casting bulk amorphous alloys (or feedstock for such alloys) directly from the melt that permit the casting of large numbers of cast articles in a cost effective and efficient manner. Exemplary approaches and systems described herein may address such needs.

SUMMARY

According to one example, a counter gravity casting apparatus, comprises a reusable metal mold comprising a plurality of mold cavities; a feed tube configured to feed molten alloy into the mold; and a vacuum fitting connected to the mold and configured to permit a sub-ambient pressure to be applied to an interior of the mold. The mold comprises multiple metal sections configured such that adjacent metal sections mate to one another, the metal sections being separable from one another, wherein the metal sections comprise recesses that form the mold cavities. The mold includes a sprue and multiple runner passages, wherein the sprue is configured to receive molten alloy from the feed tube, and wherein the multiple runner passages are configured to feed molten alloy from the sprue to the mold cavities.

According to another example, a method for counter gravity casting, comprises applying a sub-ambient pressure to an interior of a reusable metal mold comprising a plurality of mold cavities and feeding a molten alloy upward through a feed tube from a crucible and into the reusable metal mold and into the plurality of mold cavities under a pressure differential generated at least partially by the sub-ambient pressure at the interior of the mold, the mold being disposed above the crucible. The mold comprises multiple metal sections that are configured such that adjacent metal sections mate to one another, wherein the metal sections are separable from one another, and wherein the metal sections comprise recesses that form the mold cavities. The mold includes a sprue and multiple runner passages, wherein the sprue is configured to receive molten alloy from the feed tube, and wherein the multiple runner passages are configured to feed molten alloy from the sprue to the mold cavities. The method also comprises cooling the molten alloy in the mold cavities of the mold at a rate sufficient to solidify the molten alloy in the mold cavities while at least some of the molten alloy disposed within the sprue remains in a molten state. The method further comprises releasing the pressure differential to permit the molten alloy disposed within the sprue to return to the crucible, and removing the cast articles.

According to another example, an article of manufacture comprises a refractory article; a bulk metallic glass structure disposed in contact with the refractory article; and a hermetic or vacuum tight seal at an interface between the bulk metallic glass structure and the refractory article formed by a reaction of molten alloy that forms the bulk metallic glass structure with the refractory article during a casting process.

BRIEF DESCRIPTION OF THE FIGURES

These and other features, aspects, and advantages of the present disclosure will become better understood with regard to the following description, appended claims, and accompanying drawings.

DETAILED DESCRIPTION OF EXEMPLARY EMBODIMENTS

The present inventors have developed approaches for casting bulk amorphous alloys (or feedstock for such alloys) directly from the melt that permit the casting of large numbers of cast articles in a cost effective and efficient manner, as described in connection with the exemplary embodiments set forth herein.

Figure 1:
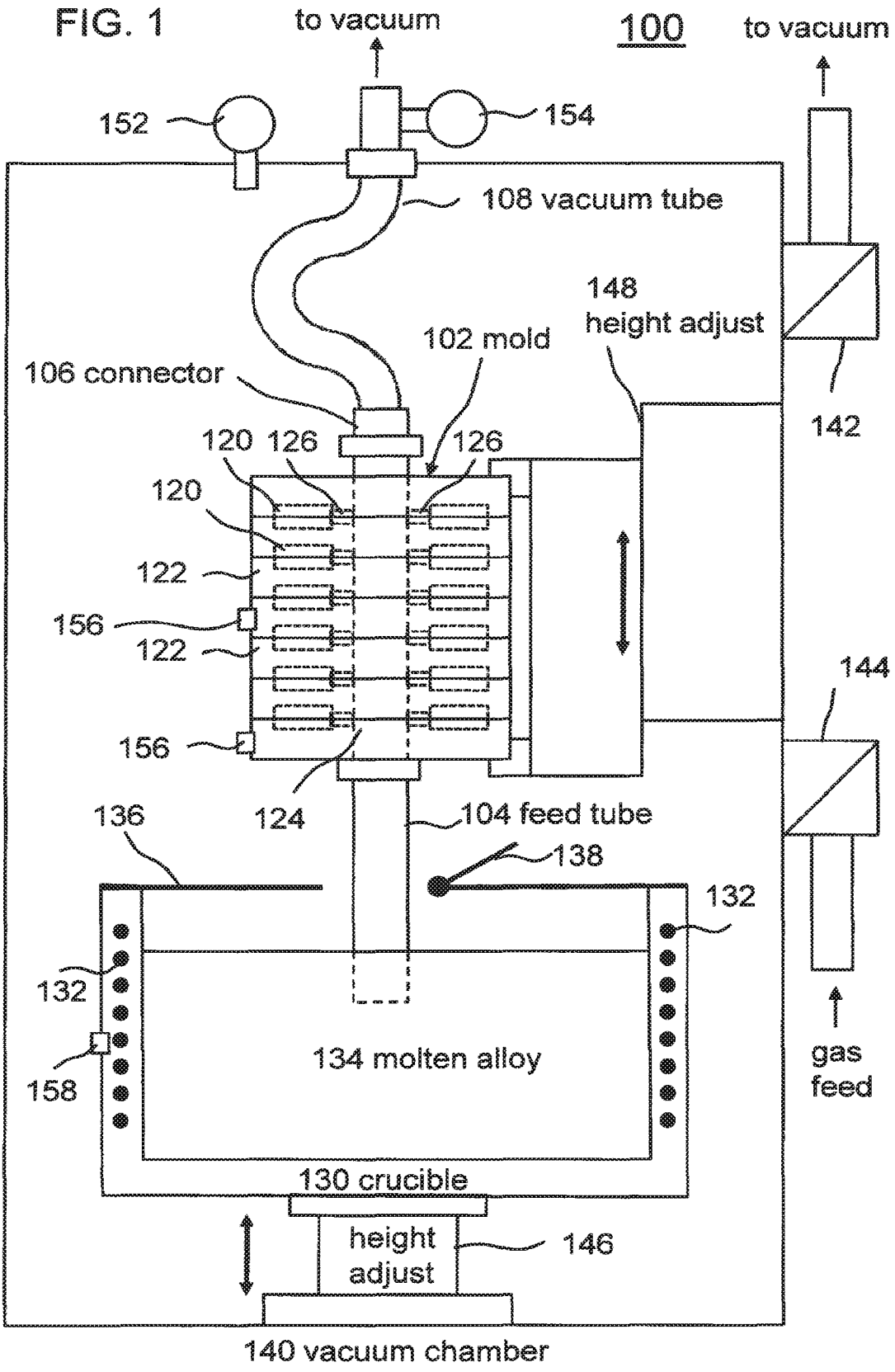
FIG. 1 illustrates an exemplary counter gravity casting apparatus according to an exemplary embodiment.

FIG. 1 illustrates an exemplary counter gravity casting apparatus 100 according to an exemplary embodiment. In this example, the apparatus 100 comprises a reusable metal mold 102, a crucible 130 for melting an alloy and for holding the molten alloy 134, a vacuum chamber 140 in which the mold 102, the crucible 130 and other components are disposed, and a feed tube 104 configured to feed molten alloy 134 into the mold 102. A vacuum fitting or connector 106 is connected to the top of the mold 102 and is configured to permit a sub-ambient pressure to be applied to an interior of the mold 102 via a vacuum tube, which can be connected to a suitable vacuum system including one or more vacuum pumps, pressure gauges, gas flow controllers and sources of gas (e.g., inert gas) so as to maintain a controllable pressure at the interior of the mold 102 in the range of atmospheric pressure (760 Torr) to sub-ambient pressures less than atmospheric pressure (e.g., a few hundred Torr to $10^{-6}$ Torr), including low vacuums (e.g., $10^{-2}$–$10^{-6}$ Torr, for instance).

A vacuum valve 142 connected to a port of the vacuum chamber 140 is connected to a vacuum system (e.g., the same vacuum system or a different vacuum system) to evacuate the chamber 140 and maintain a desired level of pressure/vacuum in the chamber 140. A valve 144 is connected to a port on the vacuum chamber 140 to permit gas, e.g., inert gas such as argon, nitrogen, etc., to be fed into the chamber 140 to maintain a desired gaseous environment in the chamber 140 at a desired pressure. One or more pressure sensors 152 may be provided for measuring the pressure in the vacuum chamber 140, and one or more pressure sensors 154 may be provided for measuring the pressure in the vacuum arrangement (vacuum tube 108 and associated suitable connectors and valves) that communicates with the interior of the mold 102. Any suitable combination of gas flow controllers, pressure sensors, vacuum pumps and associated vacuum plumbing may be utilized to control the vacuum/pressure conditions and gaseous environment of the vacuum chamber 140.

One or more temperature sensors 156 (e.g., thermocouples) for measuring the temperature of one or more locations of the mold 102, and one or more temperature sensors 158 for measuring the temperature of one or more locations of the crucible 130, e.g., to monitor the temperature of the molten alloy 134. The crucible 130 may be heated by an induction heating coil 132, or by any other suitable means of heating, to both melt alloy constituents at the outset to make the alloy 134 and/or to heat the molten alloy 134 to maintain it a desired temperature.

The apparatus 100 also comprises a drive system, e.g., 146 and or 148, for controllably changing a vertical distance between the mold 102 and the crucible 130. Either, or both, of these exemplary drive systems permits the feed tube 104 to be immersed in the molten alloy 134, either by lowering the mold 102 toward the crucible 130, or by raising the crucible 130 toward the mold 102. The crucible may also comprise a cover 136 that has a movable lid 138 for exposing and covering a portion of the crucible 130. The lid 138 can be opened (using any suitable mechanical control system) when the feed tube 104 approaches the crucible 130, and the lid 138 can be closed after the feed tube 104 is removed from the crucible 130. Covering the molten alloy 134 with the movable lid 138 can be useful for avoiding potential contamination of the molten alloy 134 both before the feed tube 104 is immersed in the molten alloy 134 for a casting event and after the feed tube 104 is removed from the molten alloy 134 following a casting event (so as to avoid contamination in preparation for a next casting event). In particular, this can prevent portions of the feed tube 104 from contaminating the molten alloy 134 should the feed tube crack after removal from the crucible. While FIG. 1 illustrates the mold 102 and the crucible 130 in one (i.e., the same) chamber 140, the mold 102 and the crucible 130 could be situated in separate vacuum chambers that communicate with one another via a gate value. For instance, the crucible 130 could be situated in one vacuum chamber at one pressure, e.g., 5 psi, and the mold 102 could be situated in a separate vacuum chamber and could be brought to the same pressure, e.g., 5 psi. Each such vacuum chamber can have its own suitable vacuum plumbing, values, pressure sensors and vacuum pumps, etc. The vacuum chamber containing the mold 102 and the separate vacuum chamber containing the crucible 130 need not be brought to the same pressure level at the same time, but they should be brought to the same pressure level just prior to the opening of the gate valve that separates the two separate chambers for a casting event.

Figure 2:
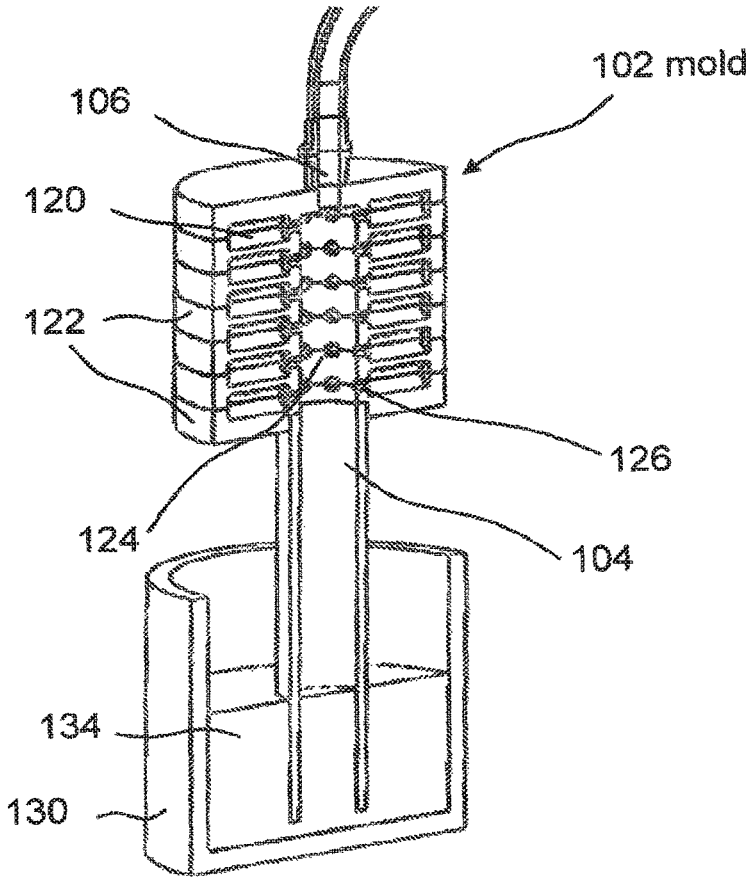
FIG. 2 illustrates a perspective view of a portion of the exemplary counter gravity apparatus shown in FIG. 1.
Figure 3A:
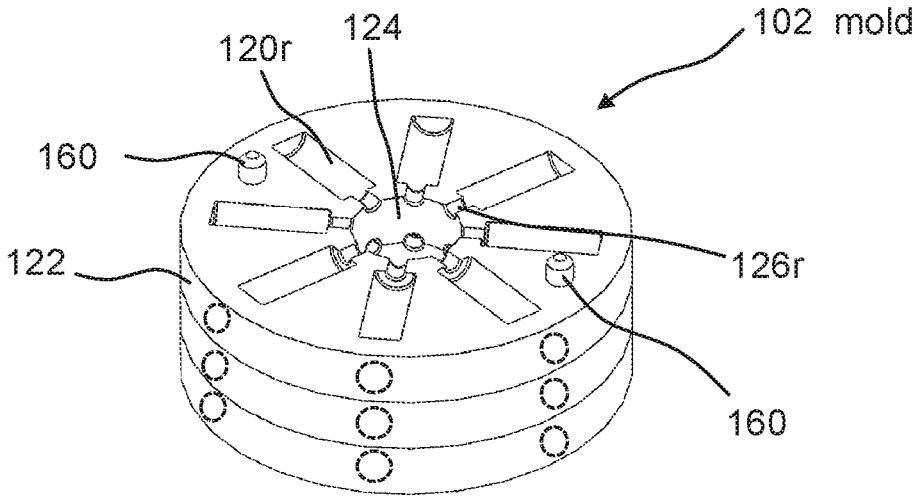
FIG. 3A illustrates a perspective view of a portion of an exemplary reusable metal mold configuration according to an exemplary embodiment.

In the example of FIG. 1, the reusable metal mold 102 comprises a plurality of mold cavities 120 connected to a sprue 124 (e.g., a central sprue) via multiple runner passages 126. The mold 102 comprises multiple sections 122 (e.g., metal plates) configured such that adjacent sections 122 mate to one another so as to form the mold cavities 120, wherein the sections 122 are separable from one another. As shown in this example, the multiple metal sections 122 of the mold 102 may comprise metal plates oriented substantially horizontally. A sectional perspective view of the mold 102 is illustrated in FIG. 2, and a perspective view of a bottom portion (several sections 122) of the mold 102 is shown in FIG. 3A. As shown in FIG. 3A, a given section 122 comprises cavity recesses **120*r*, each of which forms a portion of a mold cavity 120, e.g., one-half of a mold cavity 120 in this example. The sections 122 in this example possess such recesses 120*r* at opposing sides of the section 122. Likewise, a given section 122 comprises runner recesses 126*r*, each of which forms a portion of a runner passage 126, e.g., one-half of a runner passage 126 in this example. When the sections 122 of the metal mold 120 are positioned together side-by-side, these recesses 120***r* and 126*r* form the mold cavities 120 and runner passages 126, respectively. As shown in FIGS. 1 and 2, the sprue 124 is configured to receive molten alloy 134 from the feed tube 104, and the multiple runner passages 126 are configured to feed molten alloy 134 from the sprue 124 to the mold cavities 120. In some examples, multiple runner passages 126 may feed a single mold cavity 120 from any side of the mold cavity 120.

The mold 120 can be machined out of various metals, such as, for example, Cu, CuBe, various tool steels such as H13, P20, etc., INCONEL®, stainless steel, and the like. The metal from which to fabricate the mold may also be an alloy formed of at least some the same constituents as the alloy being cast so as to reduce the potential for contamination of the cast alloy from erosion of the mold. Inner surfaces of the mold 102 including the mold cavities 120 and the runner passages 126 may be coated, if desired, with zirconia, yttria, or other suitable coatings to protect and enhance the longevity of those surfaces. The feed tube 104 may be formed from quartz, zirconia, or other suitable refractory materials, and may range in diameter from about 10 mm to about 50 mm, though other diameters are possible as well. The feed tube 104 may be connected to the bottom of the mold 102 using any suitable tube connector, e.g., compression fitting, or may be fixed in place by providing a lip to the upper portion of the feed tube 104 that is then supported with a screw nut containing a hold for the feed tube 104.

Also shown in the example of FIG. 3A are alignment pins 160 extending from a surface of the section 122, which mate to corresponding alignment holes in an adjacent metal. Of course, this method of alignment is exemplary and any suitable approach for maintaining proper alignment between sections 122 may be used. The mold 102 may be held together by any suitable clamping or fastening mechanisms, e.g., clips, clamps, etc., so that the sections 122 of the mold 102 are held in intimate contact for the casting process. Metal or polymer gaskets may also be placed between adjacent sections 122 of the mold 102 to promote vacuum tight interfaces between the sections 122 as long as such gaskets do not interfere with the arrangement and tightness of the mold cavities 102. In addition, separation springs may be placed between adjacent sections 122 of the mold 102 so that when the casting process is completed and the mold fasteners (e.g., clips, claims, etc.) are released, the sections 122 of the mold will be forced apart by the springs to facilitate removal of the cast articles from the mold cavities 120. In another example, the sections 122 may be configured such that the sprue opening 124 of each section tapers slightly such that the overall sprue 124 is tapered to be of relatively smaller diameter closer to the top of the mold 102 and of relatively larger diameter closer to the bottom of the mold 102. This tapered sprue shape may further facilitate separation of the mold sections 122.

Figure 3B:
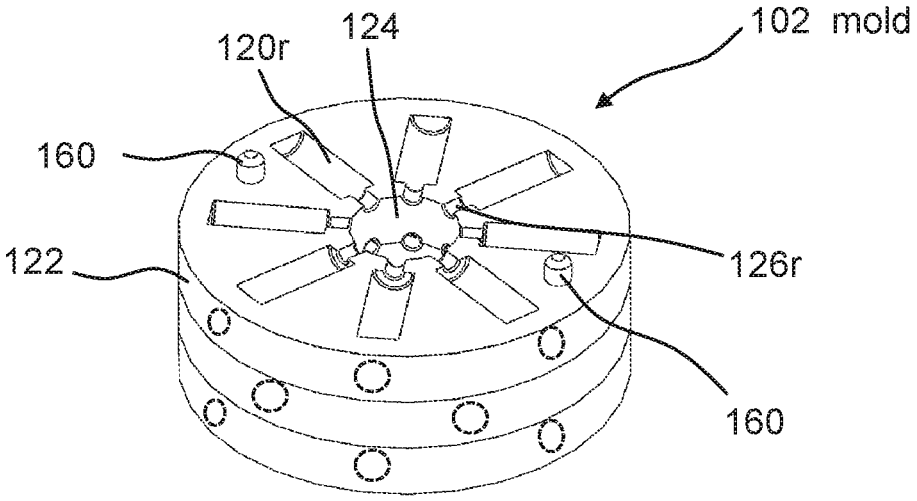
FIG. 3B illustrates a perspective view of a portion of another exemplary reusable metal mold configuration according to another exemplary embodiment.

In the example of FIG. 3A, adjacent mold cavities 120 in adjacent sections 122 that are vertically aligned with one another, as shown by adjacent dotted circles positioned at the front peripheral surfaces of the sections 122, which represent the outer radial position of the mold cavities 120 in this example. FIG. 3A thus illustrates an example wherein groups of mold cavities 120 are arranged at respective planes (imaginary planes on which the various sections 122 are positioned) in the mold 102, and wherein mold cavities 120 at one plane are aligned with mold cavities 120 at an adjacent plane in a direction perpendicular to the planes. Alternatively, groups of mold cavities 120 can be arranged at respective planes in the mold 102, wherein mold cavities 120 at one plane are staggered relative to mold cavities at an adjacent plane so as to not be aligned in a direction perpendicular to the planes. Such an exemplary configuration is shown in FIG. 3B, where mold cavities 120 of adjacent sections 122 are staggered relative to one another, as shown by the staggered dotted circles positioned at the front peripheral surfaces of the sections 122, which represent the outer radial position of the mold cavities 120 in this example.

In the examples of FIGS. 1, 2, 3A and 3B, the runner passages 126 are positioned along center lines of the mold cavities 120. However, the runner passages 126 could be positioned to be aligned with the tops of the mold cavities 120 or aligned with the bottoms of the mold cavities 120. Moreover, while the runner passages 126 illustrated in FIGS. 1, 2, 3A and 3B are shown as being circular in cross section, the runner passages 126, as well as the mold cavities 120, could have other cross sectional shapes such as square, rectangular or other shapes. In such instances, the runner passage 126 that feeds a given mold cavity 120 could be positioned above the mold cavity 120 or below the mold cavity 120 in the vertical direction so as to feed the mold cavity from the top or bottom, respectively.

The mold 102 can be machined out of various metals, such as, for example, Cu, CuBe, various tool steels such as H13, P20, etc., INCONEL®, stainless steel, and the like. Preferably, the metal for mold 120 should be readily machinable and should have a thermal conductivity and heat capacity on the order of the exemplary metal materials listed above so as to be able to readily remove heat from the molten alloy 134 in the mold cavities 102. In particular, the mold may be configured to cool the molten alloy 134 at a rate sufficient to solidify the molten alloy 134 in the mold cavities 102 into a bulk amorphous structure. A variety of bulk amorphous alloys are known in the art to be good bulk metallic glass (BMG) formers. These are alloys which may readily solidify from the melt directly into a bulk amorphous structure at relatively slow critical cooling rates ranging from about 100° K/sec to 0.1° K/sec. The mold can be configured to cool the molten alloy 134 at a rate sufficient to solidify the molten alloy 134 in the mold cavities 102 into a bulk amorphous structure by using a metal for the mold that has good thermal conductivity (such as noted for the example metals above) and by choosing appropriate sizes for the mold cavities depending upon the BMG being cast. For instance, various BMGs known in the art may be cast at diameters on the order of 1 mm to 10 mm directly from the melt at relatively slow critical cooling rates depending upon the particular BMG composition. Once a desired BMG composition is chosen for the casting, appropriate sized mold cavities can be chosen commensurate with known diameters obtainable in a full amorphous structure for that composition. Alternatively, suitable mold cavity sizes and shapes to obtain fully amorphous alloy structures can be determined through trial and error testing of mold fabrication metals and mold cavity sizes for desired BMG compositions.

Examples of BMG applicable for casting approaches described herein include Zirconium-based BMGs, Titanium-based BMGs, Beryllium containing BMGs, Magnesium-based BMGs, Nickel-based BMGs, and Al-based BMGs, to name a few. Exemplary alloys known by trade names include VITRELOY® 1, VITRELOY® 1b, VITRELOY® 4, VITRELOY® 105, VITRELOY® 106, and VITRE- LOY® 106A. Further examples include Zr—Ti—Cu—Ni—Be BMGs, such as described in U.S. Pat. No. 5,288,344, the entire contents of which are incorporated herein by reference, and Zr—Cu—Al—Ni BMGs and Zr—Cu—Al—Ni—Nb BMGs, such as described in U.S. Pat. Nos. 6,592,689 and 7,070,665, the entire contents of each of which are incorporated herein by reference. Examples also include Zr—(Ni, Cu, Fe, Co, Mn)—Al BMGs, such as described in U.S. Pat. No. 5,032,196, the entire contents of which are incorporated herein by reference, and alloys described in U.S. Patent Application Publication No. 2011/0163509, the entire contents of which are incorporated herein by reference. Of course, the approaches described herein are not limited to these examples and may be applied to other BMG compositions as well. Moreover, if fully amorphous castings are not desired, relatively larger mold cavities 102 may be used.

Figure 4A:
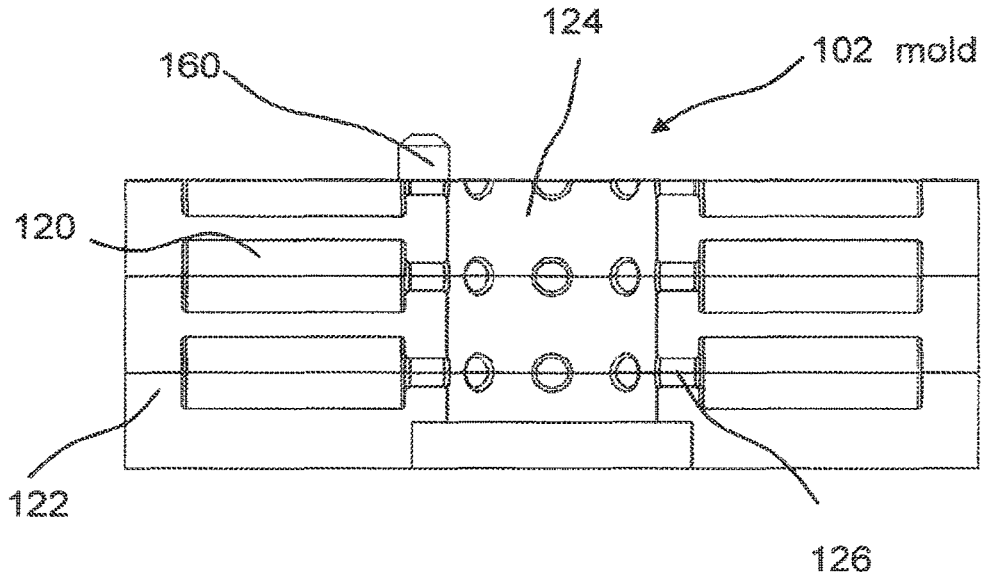
FIG. 4A illustrates a cross-sectional side view of a portion of an exemplary reusable metal mold configuration according to an exemplary embodiment.
Figure 4B:
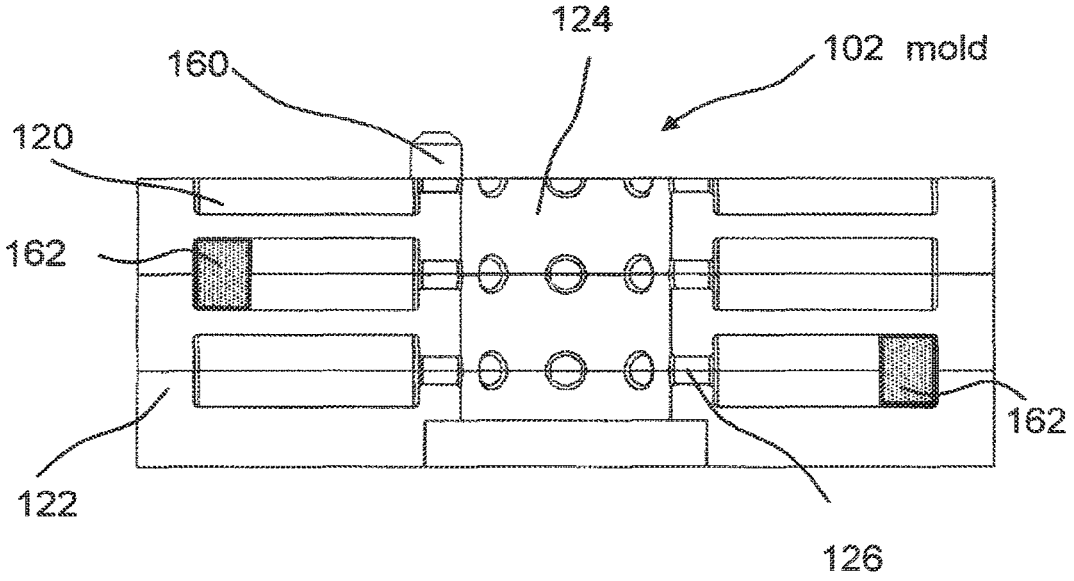
FIG. 4B illustrates a cross-sectional side view of a portion of another exemplary reusable metal mold configuration according to another exemplary embodiment.

FIG. 4B shows another exemplary mold 102 configuration according to another aspect. As shown in the example of FIG. 4B, the mold 102 may comprise inserts 162 of predetermined desired sizes configured to be positioned in at least some of the plurality of mold cavities 120 for changing sizes of those mold cavities 120. The inserts 162 may be formed in various sizes and of the same metal of which the mold sections 122 are made. The inserts 162 do not become part of the castings formed in the mold cavities 120 but rather are separable from the castings. In the example of FIG. 4B, the mold cavities 120 are cylindrical, and the inserts 162 are likewise cylindrical of commensurate diameter. By placing the inserts at the end of some or all of the mold cavities 120 during assembly of the mold 102, desired sizes for the mold cavities 120 may be obtained and multiple different sizes of mold cavities 120 may thereby be obtained for the same mold. By removing the inserts 162 after a casting event, the original mold 102 configuration may once again be obtained as shown in FIG. 4A for a next casting event. Of course, the inserts are not limited to the shapes illustrate in FIG. 4B, and any suitable shape for the insert may be used, which can then not only change the size of the cast article, but also may change the shape of the cast article to replicate a desired shape of the insert surface at its contacting surface with the molten alloy.

Figure 5A:
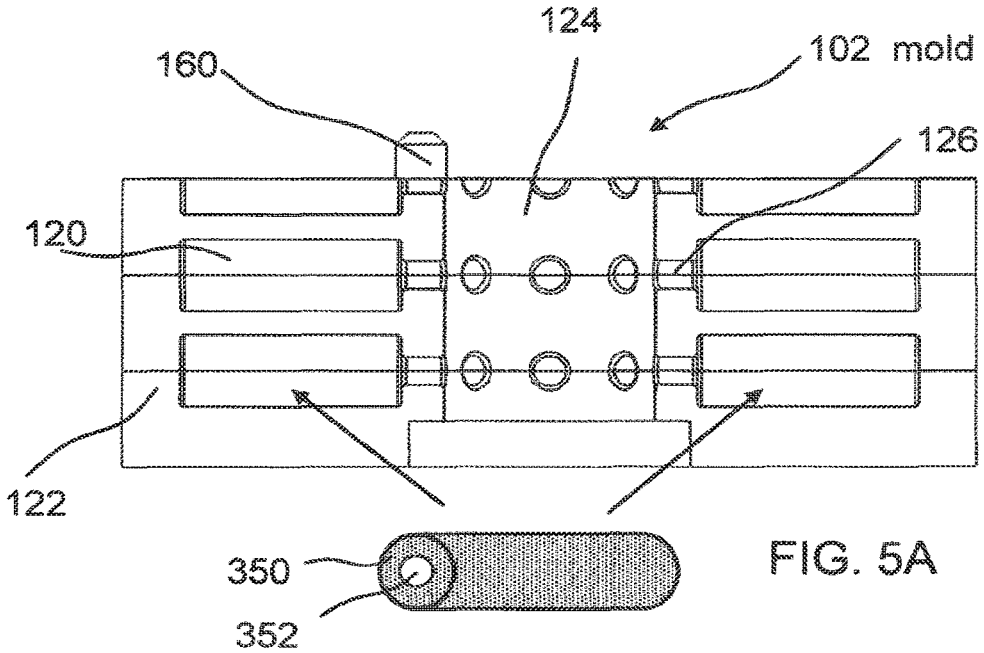
FIG. 5A illustrates a cross-sectional side view of a portion of an exemplary reusable metal mold configuration and an exemplary ceramic insert according to an exemplary embodiment.
Figure 5B:
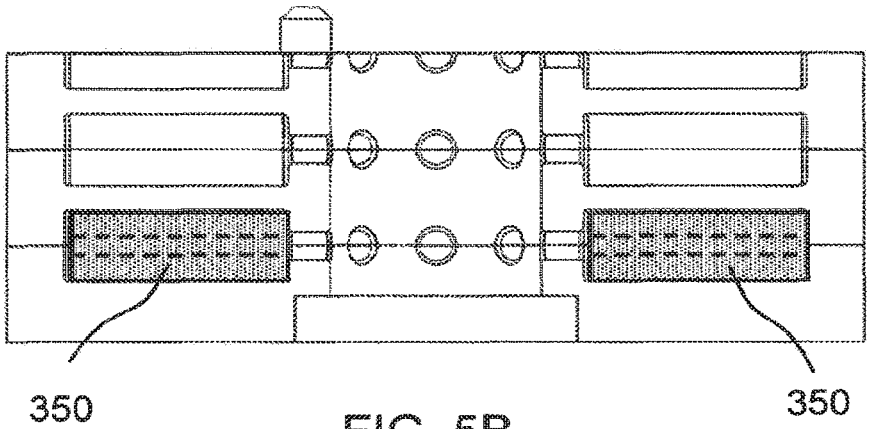
FIG. 5B illustrates a cross-sectional side view of the mold of FIG. 5A with the exemplary ceramic insert in place in the mold.
Figure 5C:
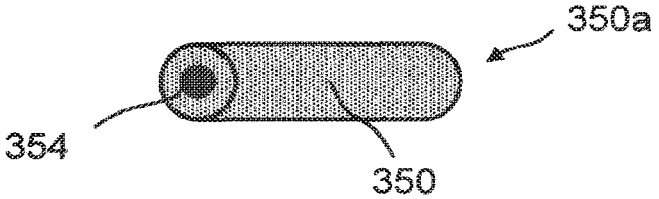
FIG. 5C illustrates an exemplary ceramic composite article with a bulk metallic glass portion resulting from a casting process using the mold and ceramic insert of FIG. 5B.

FIGS. 5A-5C illustrate an example of using a refractory article insert that may be inserted into one or more mold cavities 120 of the reusable metal mold 102 to form an exemplary composite structure comprising a refractory (e.g., ceramic) tube 350 and an alloy such as a bulk metallic glass according to another aspect. FIG. 5A shows a portion of an exemplary mold 102 configuration like that of FIG. 4A, wherein a refractory article, e.g., a ceramic member in the shape of a cylindrical tube 350 with an opening or channel 352 therethrough, may be provided in mold cavity 120. FIG. 5B shows the refractory article 350 positioned in multiple mold cavities, e.g., the two lower mold cavities 120. During a casting process, molten alloy 134 contacts the refractory article 350 positioned in the corresponding mold cavity 120, passes into and through the opening 352, and solidifies to form a composite structure 350*a* as illustrated in FIG. 5C. The composite structure 350*a* comprises an alloy 354, e.g., a bulk metallic glass, in the opening 352 in contact with the refractory tube 350. The composite structure 350*a* may thereby form bulk metallic glass conductor 354 extending through the cylindrical ceramic tube 350.

Figure 6A:
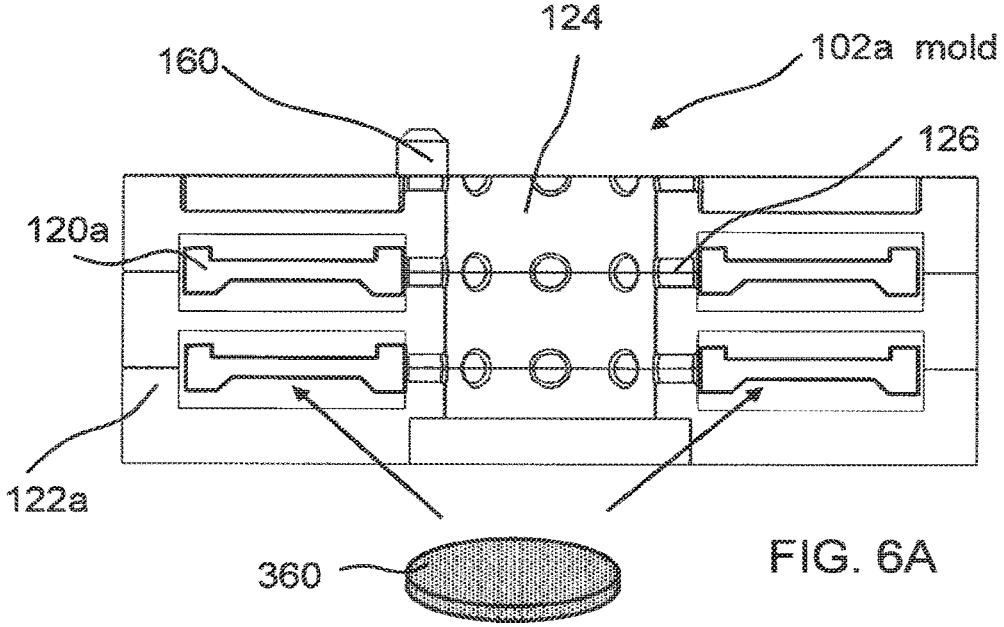
FIG. 6A illustrates a cross-sectional side view of a portion of another exemplary reusable metal mold configuration and another exemplary ceramic insert according to an exemplary embodiment.
Figure 6B:
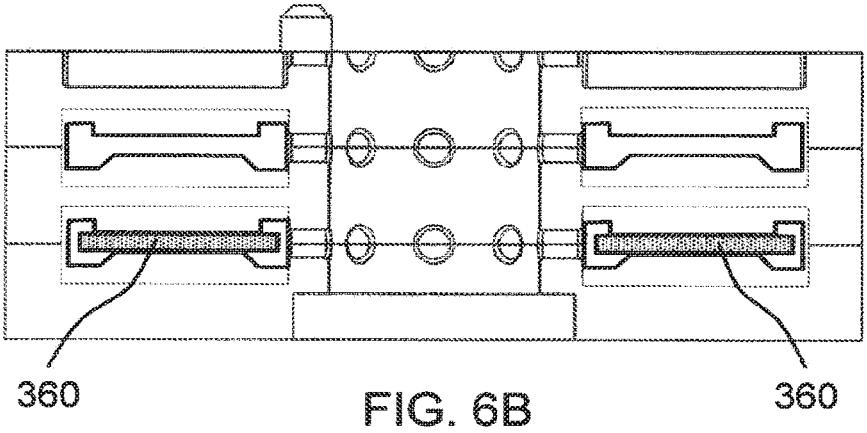
FIG. 6B illustrates a cross-sectional side view of the mold of FIG. 6A with the exemplary ceramic insert in place in the mold.
Figure 6C:
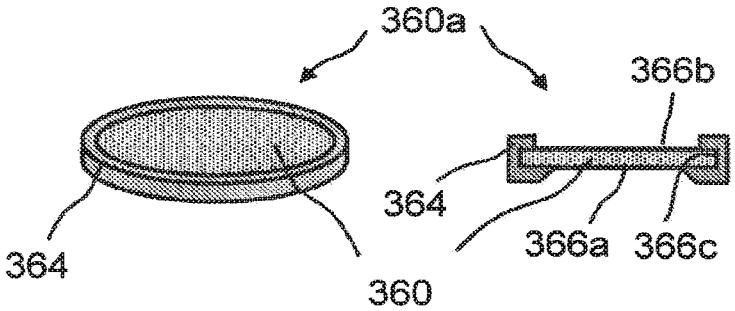
FIG. 6C illustrates another exemplary ceramic composite article with a bulk metallic glass portion resulting from a casting process using the mold and ceramic insert of FIG. 6B.

FIGS. 6A-6C illustrate another example of using a refractory article insert that may be inserted into one or more mold cavities 120*a* of an exemplary reusable metal mold 102*a* to form an exemplary composite structure comprising a refractory (e.g., ceramic) substrate 360, e.g., a disk shaped ceramic substrate, and an alloy such as a bulk metallic glass according to another aspect. FIG. 6A shows a portion of an exemplary mold 102*a* configuration wherein the mold cavities 120*a* are shaped to accommodate a disk shaped refractory substrate 360. In this example, as shown in FIG. 6B, adjacent sections 122*a* of the mold 102 press against the refractory disk 360, leaving an opening at a periphery of the refractory disk 360. Proper alignment of the disks 360 with the mold cavities 120*a* may be accomplished in any suitable way, such as, for instance, applying temporary alignment bumps of an easily removable material such as wax to one surface of the disks so as to mate with corresponding alignment recesses in a corresponding surface of the mold cavity 120*a*. The mold cavities 120*a* in this example have a circular shape in top view such that a ring shaped cavity remains in the mold cavity 120*a* surrounding a periphery of the refractory disk 360. Runner passages 126 feed molten alloy 134 into the portions of the mold cavities not occupied by the refractory disk 360. After casting, the sections 122*a* may be separated, and the composite article 360*a* may be removed from the mold 102*a*. The composite article 360*a* comprises an alloy 364, e.g., bulk metallic glass, in contact with the substrate 360, e.g., a seal in the form of a ring of bulk metallic glass 364 encircling a periphery of the substrate 360 including the outer curved surface of the disk shaped substrate 360 as well as one or both of the major surfaces of the disk shaped substrate 360.

In the examples of FIGS. 5A-5C and 6A-6C, a hermetic seal or vacuum tight seal may be formed at an interface between the bulk metallic glass portion 354, 364 and the corresponding refractory article 350, 360. Such a hermetic seal or vacuum tight seal between the ceramic and an amorphous alloy may be formed by heating the alloy above the melt temperature (Tm) so that the alloy contacts the ceramic member while the alloy is in a molten state, and cooling at a rate sufficient to form an amorphous metallic—ceramic seal. One potential advantage of this approach is that the molten alloys may have a higher diffusivity and reactivity at temperatures above Tm, thereby promoting the formation of a strong bond with the ceramic.

The refractory article can be a ceramic material such as, for example, $Al_2O_3$, mullite (alumina with silica), BeO, $ZrO_2$, $SiO_2$, $TiO_2$, MgO, porcelain, white ware ceramics, various nitrides, various carbides, or any other suitable ceramic material. The refractory article can also be refractory metals such as tantalum, tungsten, molybdenum, niobium and alloys thereof. The amorphous alloy can be, for example, Zirconium-based BMGs, Titanium-based BMGs, Beryllium containing BMGs, Magnesium-based BMGs, Nickel-based BMGs, and Al-based BMGs, to name a few. Examples include alloys known by trade names VITRELOY® 1, VITRELOY® 1b, VITRELOY® 4, VITRELOY® 105, VITRELOY® 106, and VITRELOY® 106A. Further examples include Zr—Ti—Cu—Ni—Be BMGs, such as described in U.S. Pat. No. 5,288,344, Zr—Cu—Al—Ni BMGs, and Zr—Cu—Al—Ni—Nb BMGs, such as described in U.S. Pat. Nos. 6,592,689 and 7,070,665. Other examples also include Zr—(Ni, Cu, Fe, Co, Mn)—Al BMGs, such as described in U.S. Pat. No. 5,032,196, and alloys described in U.S. Patent Application Publication No. 20110163509. Other BMGs may also be used.

The composite article 350*a* illustrated in FIG. 5C may serve as a useful electrical conducting device with a ceramic portion 350 (e.g., electrically insulating ceramic) and conductive BMG portion 354. A robust and reliable hermetic seal may formed at one or more interfaces between the ceramic and BMG can make the conducting article resistant to corrosion, environmental elements, or other harsh environments. While the article 350*a* is illustrated in the form of an elongated cylindrical tube 350 with a cylindrical opening 352 containing the BMG conductor 354, each with a circular cross section, any suitable geometry for the article 350*a* could be used. For instance, each of the ceramic portion 350, the opening 352 and the conductor 354 may have any suitable cross sectional shape, such as, for instance, square, rectangle, oval, triangle, hexagon, other shape, or any combination thereof.

The composite article 360*a* illustrated in FIG. 6C may serve as a useful sealing element with the ceramic disk shaped substrate 360 and the BMG sealing portion 364. A hermetic seal or vacuum tight seal may be formed at the interface between the sealing portion 364 and the substrate 360. The BMG sealing portion 364 may be present at just one of the major surfaces 366*a* of the substrate 360, or the BMG sealing portion 364 may be present at the major surface 366*a* and the side surface 366*c*, or at both major surfaces 366*a* and 366*b* as well as the side surface 366*c*. While the composite article 360*a* is shown as having a circular cross section in this example, the composite article 360*a* may have any suitable cross sectional shape such as, for instance, square, rectangle, oval, triangle, hexagon, other shape, or any combination thereof.

The articles 350*a* and 360*a* may be made by counter gravity casting the molten alloy 134 as described herein in contact with the refractory articles 350 and 360 so as to achieve suitable wetting of the refractory material by the molten alloy 134 in conjunction with subsequent cooling, e.g., at a cooling rate sufficient to achieve a primarily amorphous state for the sealing portion 364. It is believed that hermetic seals or vacuum tight seals may be obtained by the approaches described herein because the casting is done at elevated temperatures above Tm, so as to provide the ability for the molten amorphous alloy to react and bond with the surface of the refractory material. In this regard, it is believed that Zr-based based BMGs, can be advantageous insofar as the Zr constituent may promote a strong bond and seal with refractory materials such as ceramics. BMG alloys that are more stable in an oxide state than the ceramic being bonded to may also be advantageous. In addition, good bonding and sealing may be facilitated by various surface treatments applied to the ceramic form or substrate. In this regard, surface treatments comprising chemical etching with acids such as hydrofluoric acid, sulfuric acid, hydrochloric acid, acetic acid, for example, or combinations thereof, followed by rinsing in deionized water and subsequent drying, for instance, may be beneficial. Alternatively, or in addition, surface treatments comprising ion milling, ion sputtering, plasma treatment, mechanical polishing and/or roughening, or combinations thereof may be useful to promote good seals.

Figure 7A:
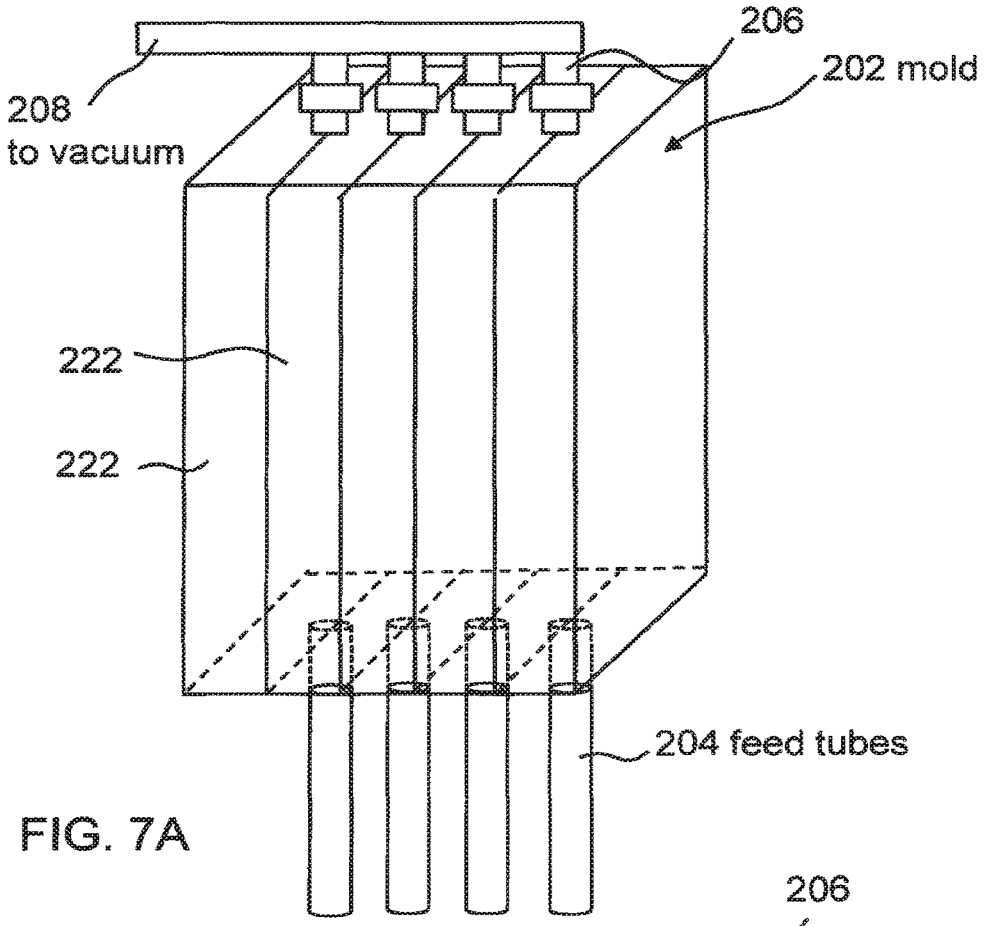
FIG. 7A illustrates a perspective view of a portion of another exemplary counter gravity system having multiple feed tubes according to an exemplary embodiment.
Figure 7B:
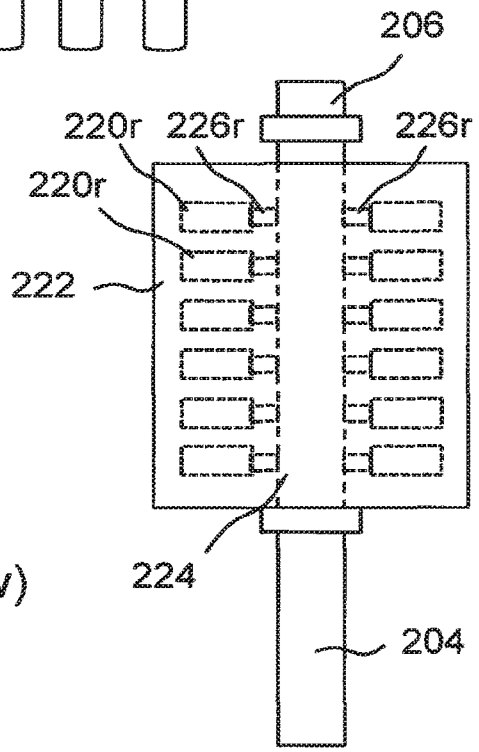
FIG. 7B illustrates a cross-sectional side view of one section (plate) of the exemplary reusable metal mold illustrated in FIG. 5A.

FIG. 7A illustrates a portion of another exemplary counter gravity apparatus, and in particular shows an exemplary configuration for a reusable metal mold 202 with multiple feeder tubes 204. In this example, the mold 202 is comprised of multiple vertically oriented sections 222 (e.g., metal plates). Also provided are vacuum fittings 206 connected to the mold 202 that are attached to a vacuum tube 208 that communicates with a vacuum system as previously described. FIG. 7B illustrates a side view of a particular section 222, showing recesses 220*r* that form vacuum cavities, recesses 226*r* that form runner passages, and a sprue 224 that feeds molten alloy to the runner passages and mold cavities, such as described previously. As shown in this example, the multiple metal sections 222 of the mold 102 may comprise metal plates oriented substantially vertically.

Figure 8:
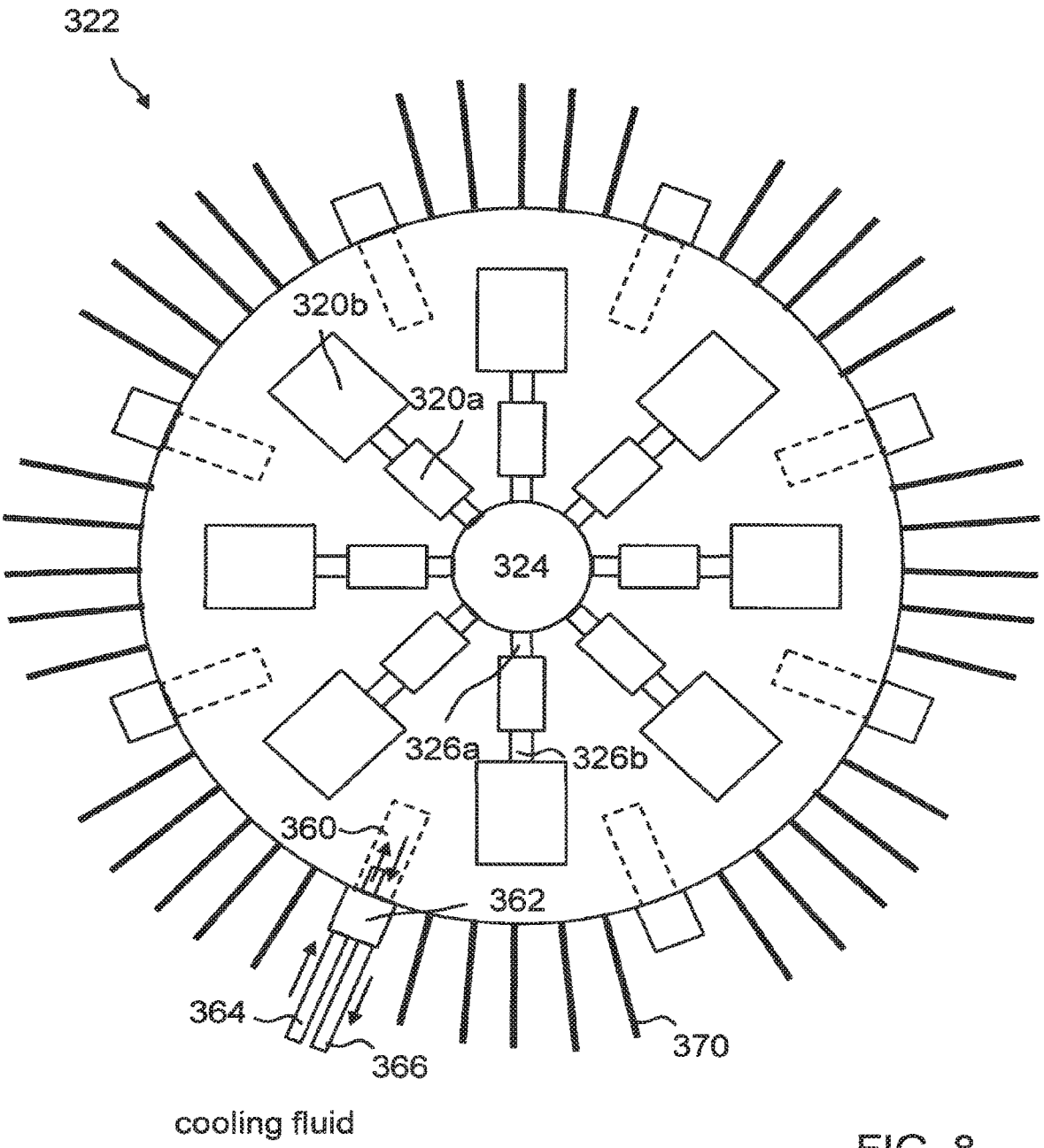
FIG. 8 illustrates a cross sectional view of another exemplary configuration of one section (plate) of an exemplary reusable metal mold that provides liquid cooling and/or heat-fin cooling according to an exemplary embodiment.

FIG. 8 illustrates a further exemplary variation for a section 322 (e.g., metal plate) of the reusable metal mold 102 according to another example wherein the mold may be configured to be controllably cooled. As shown in FIG. 8, a mold 102 comprising sections 322 can provide for cooling the mold 102. For example, section 322 comprises fluid fittings 362, which may permit cooling fluid, such as water or oil, for example, to pass from a recirculating cooler through an inlet tube 364 into an interior cooling cavity 360 of the section 322 and back out again to the recirculating cooler through an outlet tube 366. Cooling may also be provided by a sleeve of cooling fins 370 positioned at an outer surface of each section 322 of the mold 102, which may transfer heat from the mold to a cooling gas, for example, introduced near and around the mold 102. The cooling fins may be made from any suitable conventional metallic material commonly used for cooling fins, such as copper, aluminum, etc. In another example, instead of cooling fins, a fluid jacket may be provided around the outer surface of the mold to provide cooling by circulating a fluid through the jacket. A feedback system may be used to control the cooling of the mold 102 by monitoring the temperature via temperature sensors such as previously mentioned and controlling the application of cooling fluid or cooling gas in dependence upon the measured temperature or temperatures.

FIG. 8 also shows another exemplary aspect, wherein the plurality of mold cavities include mold cavities of different sizes. In the example of FIG. 8, for instance, recesses 320*a* may form mold cavities of one size, and recesses 320*b* may form mold cavities of a larger size. Also, recesses 326*a* and 326*b* may form runner passages between the sprue 324 and between adjacent mold cavities, respectively. Moreover, additional runner passages may be provided between any adjacent mold cavities, whether or not those mold cavities are located on the same radial line, so as to increase the number and density of mold cavities and the number of runner passages available to fill the mold cavities. Moreover, while mold cavities of different sizes may be symmetrically distributed over a given pair of plates 322 (e.g., rotationally symmetrical about central sprue 324 as shown in FIG. 8), mold cavities of different sizes need not be symmetrically distributed.

Mold cavities of a variety sizes and shapes may be used. According to certain examples, where fully amorphous cast BMG articles are desired, the diameters of the mold cavities 120 may range from less than 1 mm up to about 10 mm. For castings of alloy feedstock that do not need to be fully amorphous in structure, mold cavities may be even larger in diameter, e.g., 2 cm, 3 cm, 4 cm, 5 cm or more. As shown in FIGS. 1, 2, 3A and 3B, the mold cavities 120 may by cylindrical in shape, and exemplary dimensions for casting fully amorphous BMG cylindrical slugs include diameters in the range of about 1-10 mm and preferably in the range of about 4-10 mm, with lengths in the range of about 5-100 mm and preferably in the range of about 30-55 mm. Of course, the present disclosure is not limited to these exemplary ranges.

In addition, while FIGS. 1, 2, 3A and 3B illustrate cylindrically shaped mold cavities 120, mold cavities of other shapes could be utilized according to the present disclosure. Other exemplary shapes include rectangular solids, triangular solids, hexagonal solids, and more complicated shapes that can be suitably machined into the mold 102, either with or without metal mold inserts to define desired interior surface structure of the mold cavity to be replicated in the cast article. For instance, mold cavities 120 could be suitably machined to provide for the casting of near-net shape articles such as disk springs, ring structures, golf-club-face inserts, jewelry items, consumer electronics casings, etc.

Also, in some examples, a mold 102 may include sections 122 (FIG. 1), 122*a* (FIGS. 6A and 6B), 222 (FIGS. 7A and 7B), and 322 (FIG. 8), that provide mold cavities 120 of one set of sizes and shapes for one pair of sections and another set of different sizes and shapes for another pair of sections. In this regard, a library of various mold sections may be maintained that can be mixed and matched in order to configure a mold for a given casting event so as to provide in a tailored fashion a desired number and combination of particular mold cavity sizes and shapes. This flexibility to configure a mold to meet changing demands for particular casting events may enhance the efficiency and cost effectiveness of the approaches described herein.

Referring again to FIG. 1, the overall size of the mold 102 and other components of the counter gravity casting apparatus 100 can be chosen to be quite large consistent with commercial manufacturing needs. For instance, the mold could be designed to cast hundreds or thousands of articles in a single mold in a single casting event (e.g., 500-3000 articles) of the exemplary sizes noted above. Exemplary molds may range from about 0.5 to 2 feet in diameter and from about 0.5 to 5 feet in height. The number of sections, e.g., metal plates, may range from 2 to 30 sections, for example. Of course, the present disclosure is not limited to these examples. The crucible (e.g., boron nitride crucible) may be designed, for instance, to contain hundreds or thousands of pounds of molten alloy, e.g., 5000 pounds. To increase throughput, in some embodiments, the apparatus 100 may be modified so as to divide the vacuum chamber 140 into a first upper chamber section and a second lower chamber section, such that multiple mold assemblies may be positioned on a rotary stage, each with an associated upper chamber section, so that when one mold is filled with molten alloy for a casting event, the upper chamber section containing that mold assembly may then be separated from the lower chamber section containing the crucible, and the upper chamber section having the filled mold can be moved out of the way, and another upper chamber section having another mold assembly may take the place of the prior upper chamber section. A suitable gate valve may be used to isolate the crucible containing molten alloy from ambient air during placement of the next mold assembly. Alternatively, mold assemblies including the mold 102 and feed tube 104 could be shuttled in and out of a first vacuum chamber section that is separate from a second vacuum chamber section containing the crucible 130 through a suitably sized airlock, wherein the first and second vacuum chamber sections may be isolated from one another via a gate valve.

Also, a metal mold according to the present disclosure need not be comprised entirely of metal, and it is possible that a metal mold according to the present disclosure may include in its structure other types of materials such as polymers (e.g., seals), insulating materials, etc. A metal mold according to the present disclosure is still considered a metal mold even if it is comprised of other materials to the extent that the mold is predominantly metal by comprising more than half metal by volume or weight.

Figure 9:
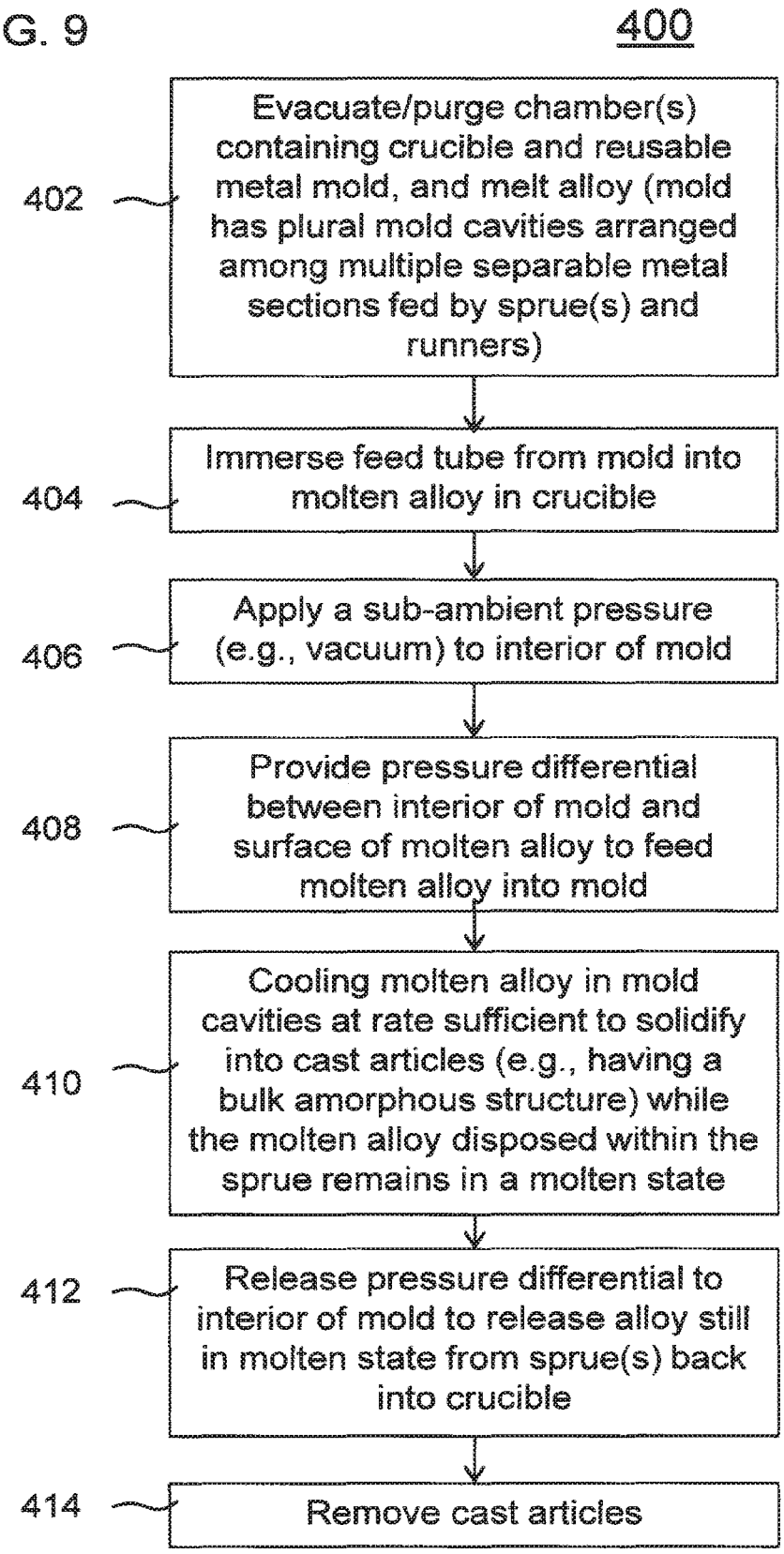
FIG. 9 illustrates a flow diagram for an exemplary method of counter gravity casting according to an exemplary embodiment.

An exemplary method for counter gravity casting will now be described. FIG. 9 illustrates a flow diagram for an exemplary method 400. Initially, a mold 102 and crucible 130 can be arranged as illustrated in FIG. 1 with various other components of the system 100 shown therein. The crucible can then be charged with the desired metal constituents to melt a desired alloy, e.g., constituents for a bulk metallic glass (BMG) forming alloy. Melting the alloy in the first instance in a section of the counter gravity casting apparatus 100 can be beneficial because it can permit the molten alloy 134 to be cast directly from that initial melt, thereby reducing the number of overall steps in the casting process and enhancing efficiency and cost effectiveness. At step 402, the chamber 140 can then be evacuated, backfilled with inert gas, e.g., argon gas, and evacuated again to purge gas impurities. This can be repeated several times, and the crucible can then be heated, e.g., with induction heating, so melt the constituents under vacuum or under inert gas to produce the molten alloy 134. At this point, the chamber 140 can be placed under a desired pressure of argon or desired inert gas so as to prevent undesired evaporation of the molten alloy. While FIG. 1 illustrates the mold 102 and the crucible 130 in one (i.e., the same) chamber 140, the mold 102 and the crucible 130 could be situated in separate vacuum chambers that communicate with one another via a gate value. For instance, the crucible 130 could be situated in one vacuum chamber a pressure, e.g., 5 psi, and the mold 102 could be situated in a separate vacuum chamber and brought to the same pressure, e.g., 5 psi. Each such vacuum chamber can have its own suitable vacuum plumbing, values, pressure sensors and vacuum pumps, etc. The vacuum chamber containing the mold 102 and the separate vacuum chamber containing the crucible 130 need not be brought to the same pressure level at the same time, but they should be brought to the same pressure level just prior to the opening of the gate valve that separates the two separate chambers for a casting event.

As described previously herein in connection with FIG. 1, the chamber 140 comprises a reusable metal mold 102 and a crucible 130 containing a molten alloy 134. The mold comprises a plurality of mold cavities 120 arranged among multiple separable metal sections 122 fed by sprue(s) 124 and runner passages 126, such as previously described. Though these features are referenced with regard to reference numerals from FIG. 1 for brevity and convenience, it should be appreciated that method 400 is applicable to all variations and examples noted in the present disclosure.

At step 404, the feed tube 104 can be immersed in the molten alloy 134 by changing a relative distance between the mold 102 and the crucible 130 as previously described. At step 406, a sub-ambient pressure can be applied to the interior of the mold 102, e.g., by lowering the pressure in the interior of the mold via the vacuum tube 108 by opening a vacuum valve to communicate with a vacuum system, optionally with the aid of a suitable gas controller to provide a sub-ambient pressure that is at an intermediate pressure higher than that of a full vacuum.

At step 408 a pressure differential is applied between the interior of the mold 102 and a surface of the molten alloy 134 to feed the molten alloy 134 upward through the feed tube 104 from the crucible 130 and into the reusable metal mold 102 and into the plurality of mold cavities 120 under the pressure differential generated at least partially by the sub-ambient pressure at the interior of the mold 102. This can be accomplished as a direct result of step 406 if the pressure in the vacuum chamber is held at a higher value than the pressure inside the mold 102 when step 406 is carried out. Or, if the same sub-ambient pressure exists both in the chamber 140 and in the mold 102 during step 404, step 406 can be accomplished by increasing a pressure of inert gas in the chamber via valve 144 so that the gas pressure at the surface of the molten alloy 134 is greater than the pressure inside the mold 102. Regardless, the pressure differential can be applied by any suitable control of both vacuum hardware and gas flow hardware while monitoring pressure via suitable pressure sensors as discussed previously.

It will be appreciated that the pressure differential applied in step 408 will directly correlate with a height of the column of molten alloy that is drawn up into the feed tube 104 and mold 102, given the known density of the molten alloy. For various BMGs of the type previously mentioned herein, a 5 psi pressure differential can raise a column of molten alloy in a feed tube 50 mm in diameter to a height of about 60 cm, for example. Once the pressure differential is applied, the molten alloy will quickly and steadily rise into the mold without turbulence so as to fill the mold cavities. Trial and error testing can be used to determine the time that it takes for a molten alloy 134 to fill a mold 102 of a given configuration.

At step 410 the molten alloy 134 in the mold cavities 120 of the mold 102 is cooled at a rate sufficient to solidify the molten alloy 134 in the mold cavities 120 into cast articles having a bulk amorphous structure while at least some of, e.g., a substantial portion of, the molten alloy 134 disposed within the sprue 124 remains in a molten state. In some examples, solidification of the molten alloy 134 (e.g., cooling below the solidus temperature or the glass transition temperature Tg) may occur within several seconds to several tens of seconds of filling the mold cavities 120, depending upon conditions, at which time at least some of the alloy, e.g., a majority of the alloy, contained within the central sprue 124 will still be in a molten state. A portion of the alloy being cast may form a thin solidified shell on the wall of the sprue 124, and this will not interfere with the ability to return the majority of the molten alloy 134 remaining in the sprue 124 back to the crucible 130. Trial and error testing can be used to determine suitable target values for the temperature of the molten alloy 134 in the crucible 130, suitable target values for the temperatures at various locations of the mold 102, suitable levels of cooling desired for various regions of the mold 102, suitable target values for the pressure differential, and suitable values for the sizes of the mold cavities 120, so as to achieve the desired rate of cooling of the alloy 134 in the mold cavities 120 and, if desired, to achieve an amorphous structure for the cast alloy, while maintaining at least some of the alloy 134 in a molten state in the sprue 124.

At step 412, the pressure differential can be released to permit the molten alloy 134 disposed within the sprue 124 to return to the crucible 130 under the force of gravity, thereby conserving material to provide a cost efficient process. As discussed previously, the feed tube 104 can then be removed from the crucible 130, and a movable lid 138 can then cover the exposed portion of the molten alloy 134 in the crucible to prevent contamination of the alloy 134. At step 414, the cast articles can be removed from the mold 102 such as previously described. The apparatus can then be readied for a next casting event.

While the present invention has been described in terms of exemplary embodiments, it will be understood by those skilled in the art that various modifications can be made thereto without departing from the scope of the invention as set forth in the claims.

What is claimed is:

1. A counter gravity casting apparatus, comprising:

a reusable metal mold comprising a plurality of mold cavities;

a feed tube configured to feed molten alloy into the mold; and a vacuum fitting connected to the mold and configured to permit a sub-ambient pressure to be applied to an interior of the mold;

wherein the mold comprises multiple metal sections configured such that adjacent metal sections mate to one another, the metal sections being separable from one another, wherein the metal sections comprise recesses that form the mold cavities, multiple distinct cavities of the plurality of mold cavities being disposed along a plane where the adjacent metal sections of the metal mold mate to one another, wherein the mold includes a sprue and multiple runner passages, wherein the sprue is configured to receive molten alloy from the feed tube, wherein the multiple runner passages are configured to feed molten alloy from the sprue to the mold cavities, and wherein the mold comprises a fluid fitting and an interior cooling cavity, the interior cooling cavity being separate and distinct from the plurality of mold cavities and the multiple runner passages, the cooling cavity being configured to receive a coolant via the fluid fitting.

2. The counter gravity casting apparatus of claim 1, wherein the mold is configured to cool the molten alloy to solidify the molten alloy into a bulk amorphous structure.

3. The counter gravity casting apparatus of claim 2, comprising a drive system for controllably changing a vertical distance between the mold and the crucible.

4. The counter gravity casting apparatus of claim 1, comprising:

a vacuum arrangement for providing a vacuum to an interior of the mold;

a crucible for holding the molten alloy; and a heater for melting separate metal constituents to produce the molten alloy held by the crucible.

5. The counter gravity casting apparatus of claim 4, comprising a vacuum chamber in which the mold and the crucible are disposed.

6. The counter gravity casting apparatus of claim 4, comprising a movable lid for exposing and covering a portion of the crucible.

7. The counter gravity casting apparatus of claim 1, wherein the mold comprises adjustable inserts configured to be positioned in at least some of the plurality of mold cavities for changing sizes of such mold cavities.

8. The counter gravity casting apparatus of claim 1, wherein the plurality of mold cavities include mold cavities of different sizes.

9. The counter gravity casting apparatus of claim 1, wherein the mold is configured to be controllably cooled.

10. The counter gravity casting apparatus of claim 1, wherein the multiple metal sections of the mold comprise metal plates oriented substantially horizontally.

11. The counter gravity casting apparatus of claim 1, wherein the multiple metal sections of the mold comprise metal plates oriented substantially vertically.

12. The counter gravity casting apparatus of claim 1, wherein the mold comprises multiple sprues, the apparatus comprising multiple feed tubes configured to feed molten alloy to the multiple sprues.

13. The counter gravity casting apparatus of claim 1, wherein groups of mold cavities are arranged at respective planes in the mold, and wherein mold cavities at one plane are staggered relative to mold cavities at an adjacent plane so as to not be aligned in a direction perpendicular to the planes.

14. A casting apparatus, comprising:

a reusable mold comprising a plurality of mold cavities;

a feed tube configured to feed molten alloy into the mold; and a connection to the mold configured to permit a sub-ambient pressure to be applied to an interior of the mold;

wherein the mold comprises multiple sections configured such that adjacent sections mate to one another, the sections being separable from one another, wherein the sections comprise recesses that form the mold cavities, multiple distinct cavities of the plurality of mold cavities being disposed along a plane where the adjacent sections of the mold mate to one another, wherein the mold includes a sprue and multiple runner passages, wherein the sprue is configured to receive molten alloy from the feed tube, wherein the multiple runner passages are configured to feed molten alloy from the sprue to the mold cavities, and wherein the mold comprises a fluid fitting and an interior cooling cavity, the interior cooling cavity being separate and distinct from the plurality of mold cavities and the multiple runner passages, the cooling cavity being configured to receive a coolant via the fluid fitting.

15. The casting apparatus of claim 14, wherein the mold is configured to cool the molten alloy to solidify the molten alloy into a bulk amorphous structure.

16. The casting apparatus of claim 14, comprising:

a vacuum arrangement for providing a vacuum to an interior of the mold;

a crucible for holding the molten alloy; and a heater for melting separate metal constituents to produce the molten alloy held by the crucible.

17. The casting apparatus of claim 16, comprising a chamber whose pressure is controllable and in which the mold is disposed.

18. The casting apparatus of claim 14, wherein the mold comprises adjustable inserts configured to be positioned in at least some of the plurality of mold cavities for changing sizes of such mold cavities.

19. The casting apparatus of claim 14, wherein the plurality of mold cavities include mold cavities of different sizes.

20. The casting apparatus of claim 14, wherein the mold is configured for its temperature to be controlled.

* * * * *